US009939835B2

(12) United States Patent
Watanabe

(10) Patent No.: US 9,939,835 B2
(45) Date of Patent: Apr. 10, 2018

(54) REFERENCE POTENTIAL GENERATION CIRCUIT

(71) Applicant: Semiconductor Energy Laboratory Co., Ltd., Atsugi-shi, Kanagawa-ken (JP)

(72) Inventor: Kazunori Watanabe, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 1212 days.

(21) Appl. No.: 13/714,877

(22) Filed: Dec. 14, 2012

(65) Prior Publication Data

US 2013/0162238 A1 Jun. 27, 2013

(30) Foreign Application Priority Data

Dec. 23, 2011 (JP) ..... 2011-282466

(51) Int. Cl.
*G05F 3/16* (2006.01)
*G05F 3/02* (2006.01)
*G05F 3/24* (2006.01)

(52) U.S. Cl.
CPC . *G05F 3/02* (2013.01); *G05F 3/24* (2013.01)

(58) Field of Classification Search
CPC ..... G05F 3/02
USPC ..... 323/313, 273–281
See application file for complete search history.

(56) References Cited

U.S. PATENT DOCUMENTS 6,437,609 B1 8/2002 Chehadi
6,525,362 B2 2/2003 Sadayuki
6,617,916 B1 9/2003 Kurotsu
6,621,329 B2 9/2003 Kajimoto
6,867,572 B1 * 3/2005 Lin ..... G05F 1/575 323/273
6,963,269 B2 11/2005 Saitoh et al.
6,984,969 B1 * 1/2006 Liu et al. ..... 323/286
(Continued)

FOREIGN PATENT DOCUMENTS

JP 06-261600 A 9/1994
JP 08-186484 A 7/1996
(Continued)

*Primary Examiner* — Adolf Berhane
*Assistant Examiner* — Afework Demisse
(74) *Attorney, Agent, or Firm* — Fish & Richardson P.C.

(57) ABSTRACT

A reference potential generation circuit is provided. The reference potential generation circuit includes first to third input terminals, first and second output terminals, a low-pass filter including first to third terminals, and a linear regulator including first to fourth terminals. In the reference potential generation circuit, the first terminal of the low-pass filter is electrically connected to the second input terminal. The second terminal of the low-pass filter is electrically connected to the first input terminal or the third input terminal. The third terminal of the low-pass filter is electrically connected to the first terminal of the linear regulator. The second terminal of the linear regulator is electrically connected to the first input terminal and the first output terminal. The third terminal of the linear regulator is electrically connected to the second output terminal. The fourth terminal of the linear regulator is electrically connected to the third input terminal.

7 Claims, 9 Drawing Sheets

(56) References Cited

U.S. PATENT DOCUMENTS

| | | | | |
|---|---|---|---|---|
| 7,068,019 | B1 * | 6/2006 | Chiu | G05F 1/575 323/273 |
| 7,255,283 | B2 | 8/2007 | Akaida et al. | |
| 7,309,978 | B2 | 12/2007 | Ku et al. | |
| 7,492,137 | B2 | 2/2009 | Yamada | |
| 7,821,242 | B2 | 10/2010 | Takagi | |
| 7,902,801 | B2 | 3/2011 | Mandal | |
| 8,278,998 | B2 | 10/2012 | Kajita | |
| 2002/0056865 | A1 | 5/2002 | Sadayuki | |
| 2003/0086278 | A1 | 5/2003 | Asami | |
| 2004/0227619 | A1 | 11/2004 | Watanabe | |
| 2005/0133605 | A1 | 6/2005 | Koyama et al. | |
| 2005/0161508 | A1 | 7/2005 | Akaida et al. | |
| 2006/0261796 | A1 | 11/2006 | Park et al. | |
| 2008/0011861 | A1 | 1/2008 | Ikeda et al. | |
| 2008/0093935 | A1 | 4/2008 | Saito et al. | |
| 2008/0150475 | A1 | 6/2008 | Kato et al. | |
| 2008/0238385 | A1 | 10/2008 | Nagata et al. | |
| 2009/0085534 | A1 | 4/2009 | Ko et al. | |
| 2009/0267585 | A1 | 10/2009 | Liu et al. | |

FOREIGN PATENT DOCUMENTS

| | | | |
|---|---|---|---|
| JP | 2001-274668 | A | 10/2001 |
| JP | 2003-143000 | A | 5/2003 |
| JP | 2003-330555 | A | 11/2003 |
| JP | 2006-101254 | A | 4/2006 |

* cited by examiner

REFERENCE POTENTIAL GENERATION CIRCUIT

BACKGROUND OF THE INVENTION

1. Field of the Invention

The invention disclosed in this specification and the like relates to a reference potential generation circuit.

2. Description of the Related Art

It is widely known that various kinds of electronic devices are grounded and use the ground potential as a reference potential in operation. Accordingly, various kinds of electronic devices have a terminal for grounding in many cases.

Patent Document 1 discloses a technique for reducing the number of input signal lines that is necessary for generating a reference voltage. The technique disclosed in Patent Document 1 uses the voltage of a signal obtained by passing a pulse signal through a low-pass filter as a reference voltage. However, supply of a ground potential to the electronic device from the outside is necessary in the technique disclosed in Patent Document 1. For this reason, an external terminal for supplying a ground potential is necessary.

REFERENCE

Patent Document

[Patent Document 1] Japanese Published Patent Application No. H6-261600

SUMMARY OF THE INVENTION

It is an object of an embodiment of the present invention to provide a reference potential generation circuit that enables operation without supply of a ground potential from the outside.

An embodiment of the present invention is a reference potential generation circuit which includes a first input terminal, a second input terminal, and a third input terminal; a first output terminal and a second output terminal; a low-pass filter including a first terminal, a second terminal, and a third terminal; and a linear regulator including a first terminal, a second terminal, a third terminal, and a fourth terminal. In the reference potential generation circuit, the first terminal of the low-pass filter is electrically connected to the second input terminal. The second terminal of the low-pass filter is electrically connected to the first input terminal or the third input terminal. The third terminal of the low-pass filter is electrically connected to the first terminal of the linear regulator. The second terminal of the linear regulator is electrically connected to the first input terminal and the first output terminal. The third terminal of the linear regulator is electrically connected to the second output terminal. The fourth terminal of the linear regulator is electrically connected to the third input terminal. A start pulse signal is supplied to the second input terminal. A potential having an opposite polarity to that supplied to the first input terminal is supplied to the third input terminal. A potential supplied from the second output terminal is a reference potential.

In the above-described structure, the low-pass filter may include a resistor and a capacitor, the first terminal of the low-pass filter may be electrically connected to one end of the resistor, the other end of the resistor may be electrically connected to the third terminal of the low-pass filter and a first electrode of the capacitor, and a second electrode of the capacitor may be electrically connected to the second terminal of the low-pass filter.

In the above-described structure, the linear regulator may include a resistor, a first p-channel transistor, a second p-channel transistor, a third p-channel transistor, a first n-channel transistor, a second n-channel transistor, a third n-channel transistor, a fourth n-channel transistor, a fifth n-channel transistor, and a sixth n-channel transistor. The first terminal of the linear regulator may be electrically connected to a gate of the second n-channel transistor. The second terminal of the linear regulator may be electrically connected to one end of the resistor of the linear regulator, one of a source and a drain of the first p-channel transistor, one of a source and a drain of the second p-channel transistor, and one of a source and a drain of the third p-channel transistor. The other of the source and the drain of the first p-channel transistor may be electrically connected to a gate of the first p-channel transistor, a gate of the second p-channel transistor, and one of a source and a drain of the first n-channel transistor. The other of the source and the drain of the second p-channel transistor may be electrically connected to a gate of the third p-channel transistor and one of a source and a drain of the second n-channel transistor. The other of the source and the drain of the second n-channel transistor and the other of the source and the drain of the first n-channel transistor may be electrically connected to one of a source and a drain of the fourth n-channel transistor. The other end of the resistor of the linear regulator may be electrically connected to one of a source and a drain of the third n-channel transistor, a gate of the third n-channel transistor, a gate of the fourth n-channel transistor, and a gate of the fifth n-channel transistor. The other of the source and the drain of the third p-channel transistor may be electrically connected to one of a source and a drain of the fifth n-channel transistor and a gate of the sixth n-channel transistor. The other of the source and the drain of the third n-channel transistor, the other of the source and the drain of the fourth n-channel transistor, the other of the source and the drain of the fifth n-channel transistor, and one of a source and a drain of the sixth n-channel transistor may be electrically connected to the fourth terminal of the linear regulator. The other of the source and the drain of the sixth n-channel transistor and a gate of the first n-channel transistor may be electrically connected to the third terminal of the linear regulator.

In the above-described structure, it is preferable that a reference potential generated from the reference potential generation circuit be substantially equal to a ground potential.

In this way, electronic devices can be operated without being supplied with a ground potential from the outside.

DETAILED DESCRIPTION OF THE INVENTION

An embodiment of the present invention will be described in detail below with reference to the accompanying drawings. However, the present invention is not limited to the following description and it is easily understood by those skilled in the art that the mode and details can be variously changed without departing from the scope and spirit of the present invention. Accordingly, the invention should not be construed as being limited to the description of the embodiment below.

Note that in the following description, ordinal numbers are used to distinguish components from one another for the sake of convenience; however, the usage of ordinal numbers is not limited to that employed in this specification. For example, a first terminal may be referred to as a second terminal.

In this specification, the terms "potential" and "voltage" are used without making a particular distinction therebetween.

Figure 1:
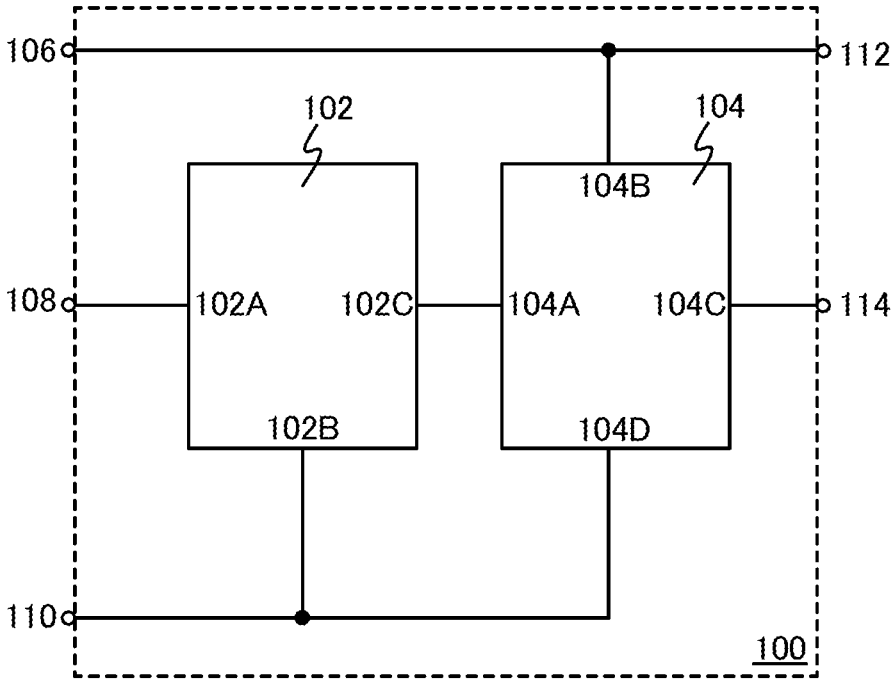
FIG. 1 illustrates a reference potential generation circuit which is an embodiment of the present invention.

FIG. 1 is a block diagram of a reference potential generation circuit which is an embodiment of the present invention.

A reference potential generation circuit 100 illustrated in FIG. 1 includes a low-pass filter 102, a linear regulator 104, a first input terminal 106, a second input terminal 108, a third input terminal 110, a first output terminal 112, and a second output terminal 114. The low-pass filter 102 includes a first terminal 102A, a second terminal 102B, and a third terminal 102C. The linear regulator 104 includes a first terminal 104A, a second terminal 104B, a third terminal 104C, and a fourth terminal 104D.

In the reference potential generation circuit 100 illustrated in FIG. 1, a start pulse signal is supplied to the second input terminal 108, a potential having an opposite polarity to that supplied to the first input terminal 106 is supplied to the third input terminal 110, and a potential supplied from the second output terminal 114 is a reference potential.

The first terminal 102A of the low-pass filter 102 is electrically connected to the second input terminal 108, the second terminal 102B of the low-pass filter 102 is electrically connected to the third input terminal 110, and the third terminal 102C of the low-pass filter 102 is electrically connected to the first terminal 104A of the linear regulator 104. The second terminal 104B of the linear regulator 104 is electrically connected to the first input terminal 106 and the first output terminal 112, the third terminal 104C of the linear regulator 104 is electrically connected to the second output terminal 114, and the fourth terminal 104D of the linear regulator 104 is electrically connected to the third input terminal 110. Although the second terminal 102B of the low-pass filter 102 is electrically connected to the third input terminal 110 in FIG. 1, the second terminal 102B may be electrically connected to the first input terminal 106.

Figure 2:
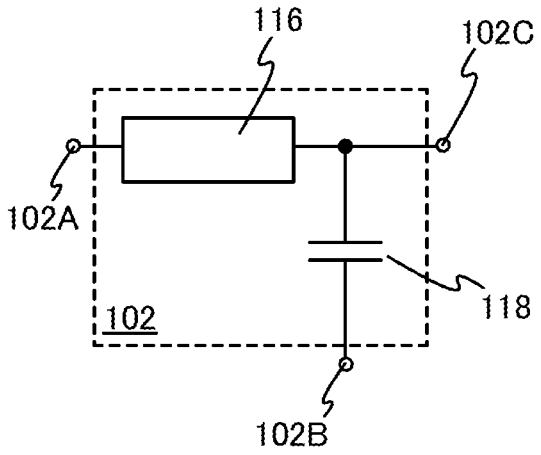
FIG. 2 illustrates an example of the circuit configuration of a low-pass filter 102 illustrated in FIG. 1.

FIG. 2 illustrates an example of the circuit configuration of the low-pass filter 102.

The low-pass filter 102 illustrated in FIG. 2 includes a resistor 116, a capacitor 118, the first terminal 102A, the second terminal 102B, and the third terminal 102C.

The first terminal 102A of the low-pass filter 102 is electrically connected to one end of the resistor 116, and the other end of the resistor 116 is electrically connected to the third terminal 102C of the low-pass filter 102 and a first electrode of the capacitor 118. A second electrode of the capacitor 118 is electrically connected to the second terminal 102B of the low-pass filter 102.

Figure 3:
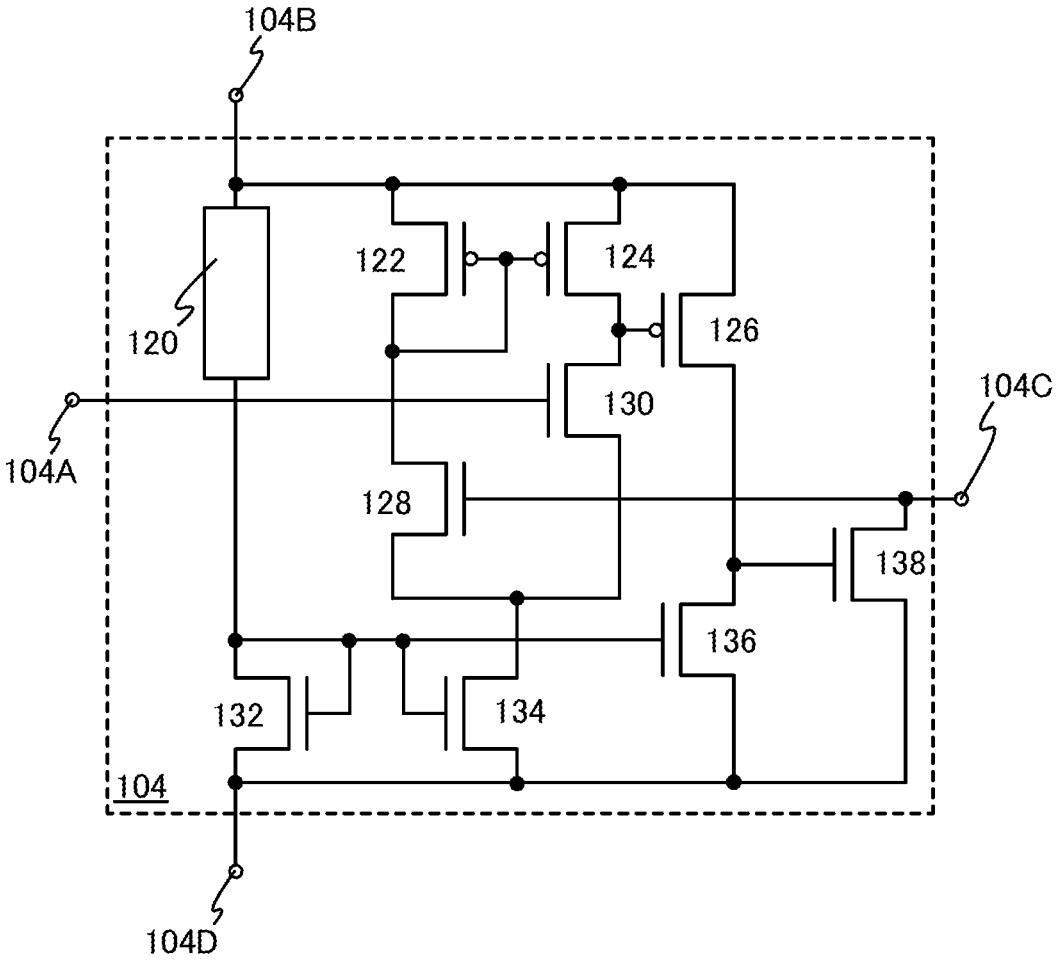
FIG. 3 illustrates an example of the circuit configuration of a linear regulator 104 illustrated in FIG. 1.

FIG. 3 illustrates an example of the circuit configuration of the linear regulator 104.

The linear regulator 104 illustrated in FIG. 3 includes a resistor 120, a first p-channel transistor 122, a second p-channel transistor 124, a third p-channel transistor 126, a first n-channel transistor 128, a second n-channel transistor 130, a third n-channel transistor 132, a fourth n-channel transistor 134, a fifth n-channel transistor 136, a sixth n-channel transistor 138, the first terminal 104A, the second terminal 104B, the third terminal 104C, and the fourth terminal 104D. The first terminal 104A of the linear regulator 104 is electrically connected to a gate of the second n-channel transistor 130. The second terminal 104B is electrically connected to one end of the resistor 120, one of a source and a drain of the first p-channel transistor 122, one of a source and a drain of the second p-channel transistor 124, and one of a source and a drain of the third p-channel transistor 126. The other of the source and the drain of the first p-channel transistor 122 is electrically connected to a gate of the first p-channel transistor 122, a gate of the second p-channel transistor 124, and one of a source and a drain of the first n-channel transistor 128. The other of the source and the drain of the second p-channel transistor 124 is electrically connected to a gate of the third p-channel transistor 126 and one of a source and a drain of the second n-channel transistor 130. The other of the source and the drain of the second n-channel transistor 130 is electrically connected to the other of the source and the drain of the first n-channel transistor 128 and one of a source and a drain of the fourth n-channel transistor 134. The other end of the resistor 120 is electrically connected to one of a source and a drain of the third n-channel transistor 132, a gate of the third n-channel transistor 132, a gate of the fourth n-channel transistor 134, and a gate of the fifth n-channel transistor 136. The other of the source and the drain of the third p-channel transistor 126 is electrically connected to one of a source and a drain of the fifth n-channel transistor 136 and a gate of the sixth n-channel transistor 138. The other of the source and the drain of the third n-channel transistor 132, the other of the source and the drain of the fourth n-channel transistor 134, the other of the source and the drain of the fifth n-channel transistor 136, and one of a source and a drain of the sixth n-channel transistor 138 are electrically connected to the fourth terminal 104D of the linear regulator 104. The other of the source and the drain of the sixth n-channel transistor 138 and a gate of the first n-channel transistor 128 are electrically connected to the third terminal 104C of the linear regulator 104.

The circuit configuration of the low-pass filter illustrated in FIG. 2 and the circuit configuration of the linear regulator illustrated in FIG. 3 are only examples and the circuit configurations of the low-pass filter and the linear regulator are not limited to those in FIG. 2 and FIG. 3.

The low-pass filter 102 illustrated in FIG. 2 is an RC filter. However, the RC filter is only an example of the circuit configuration of the low-pass filter 102 and the low-pass filter 102 is not limited to the RC filter. Other than the RC filter illustrated in FIG. 2, an RL filter, an LC filter, an RLC filter, or a differential amplifier circuit (operational amplifier) may be employed as the low-pass filter 102.

Figure 4:
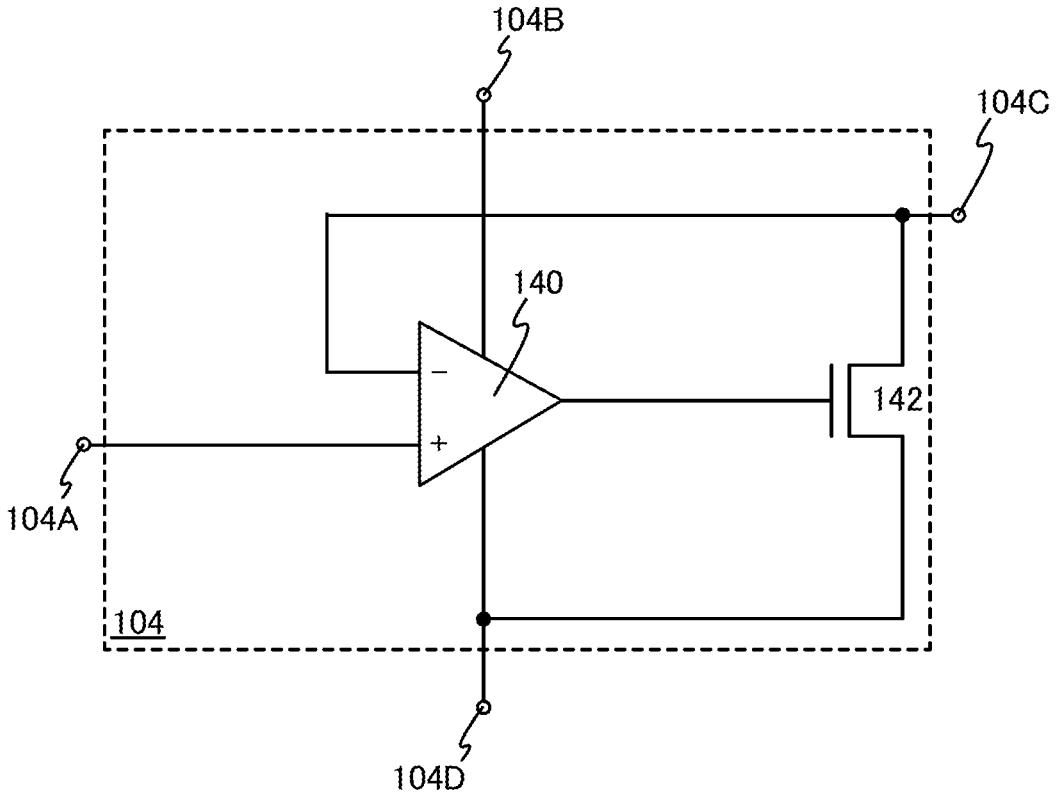
FIG. 4 illustrates another example of the circuit configuration of the linear regulator 104 illustrated in FIG. 1.

As the linear regulator, instead of the linear regulator 104 illustrated in FIG. 3, a linear regulator 104 illustrated in FIG. 4 may be used. The linear regulator 104 illustrated in FIG. 4 includes a differential amplifier circuit 140 and an n-channel transistor 142. The first terminal 104A is electrically connected to a positive input terminal of the differential amplifier circuit 140, the second terminal 104B is electrically connected to a positive power supply voltage terminal of the differential amplifier circuit 140, and the third terminal 104C is electrically connected to a negative input terminal of the differential amplifier circuit 140 and one of a source and a drain of the n-channel transistor 142. The fourth terminal 104D is electrically connected to a negative power supply voltage terminal of the differential amplifier circuit 140 and the other of the source and the drain of the n-channel transistor 142. An output terminal of the differential amplifier circuit 140 is electrically connected to a gate of the n-channel transistor 142.

In the reference potential generation circuit 100 illustrated in FIG. 1, for example, a positive potential is supplied to the first input terminal 106, a negative potential is supplied to the third input terminal 110, and a start pulse signal is supplied to the second input terminal 108, whereby the potential of the second output terminal 114 can become a predetermined reference potential. Note that since the first output terminal 112 is electrically connected to the first input terminal 106, the potential of the first output terminal 112 is equal to the potential of the first input terminal 106.

By the low-pass filter 102, at least part of the start pulse signal can be cut. In other words, the low-pass filter 102 can prevent a high potential signal from being supplied from the second input terminal 108, which enables supply of a substantially constant potential.

In the above description, the signal supplied from the first input terminal 106 has a positive potential and the signal supplied from the third input terminal 110 has a negative potential; however, they are not limited to having such potentials as long as the value of the generated reference potential is between the potential of the signal supplied from the first input terminal 106 and the potential of the signal supplied from the second input terminal 108. Note that it is preferable that there is a certain amount of difference (at least a difference of 1 V or more) between the potential of the signal supplied from the first input terminal 106 and the potential of the signal supplied from the second input terminal 108.

Note that in the case where the signal supplied from the first input terminal 106 has a positive potential and the signal supplied from the third input terminal 110 has a negative potential, it is possible to generate a potential substantially equal to a ground potential as the reference potential. Note that the "potential substantially equal to a ground potential" in this specification and the like includes a potential in a range of the potential in which the circuit operates normally. Generation of the ground potential as the reference potential is particularly preferable because an electronic device provided with the reference potential generation circuit can operate without being provided with a terminal for supplying a ground potential.

Note that a "start pulse signal" refers to a pulse signal generated by turning on a power supply of an electronic device or the like. The signal supplied to the second input terminal 108 is a start pulse signal; accordingly, it is not necessary to additionally provide a circuit or the like for generating a signal supplied to the second input terminal 108, which is preferable.

By the operation of the reference potential generation circuit described above, a reference potential supplied to a variety of electronic devices can be generated.

The potential generated by the reference potential generation circuit varies depending on the structures of the low-pass filter 102 and the linear regulator 104. As an example, calculation results of the reference potential generation circuit having the structures illustrated in FIG. 1, FIG. 2, and FIG. 3 will be described with reference to FIG. 5, FIG. 6, FIG. 7, FIG. 8, and FIG. 9.

The calculation results in FIG. 5, FIG. 6, FIG. 7, FIG. 8, and FIG. 9 were obtained under the following conditions.

The resistance of the resistor 116: $1.0\times10^{7}\Omega$

The resistance of the resistor 120: $1.0\times10^{6}\Omega$

The capacitance of the capacitor 118: $1.0\times10^{-10}$ F.

The channel length of every transistor: 5 μm

Here, a resistor with 300Ω was connected between the first output terminal 112 and the second output terminal 114.

Note that "every transistor" herein means the first p-channel transistor 122, the second p-channel transistor 124, the third p-channel transistor 126, the first n-channel transistor 128, the second n-channel transistor 130, the third n-channel transistor 132, the fourth n-channel transistor 134, the fifth n-channel transistor 136, and the sixth n-channel transistor 138.

Figure 5:
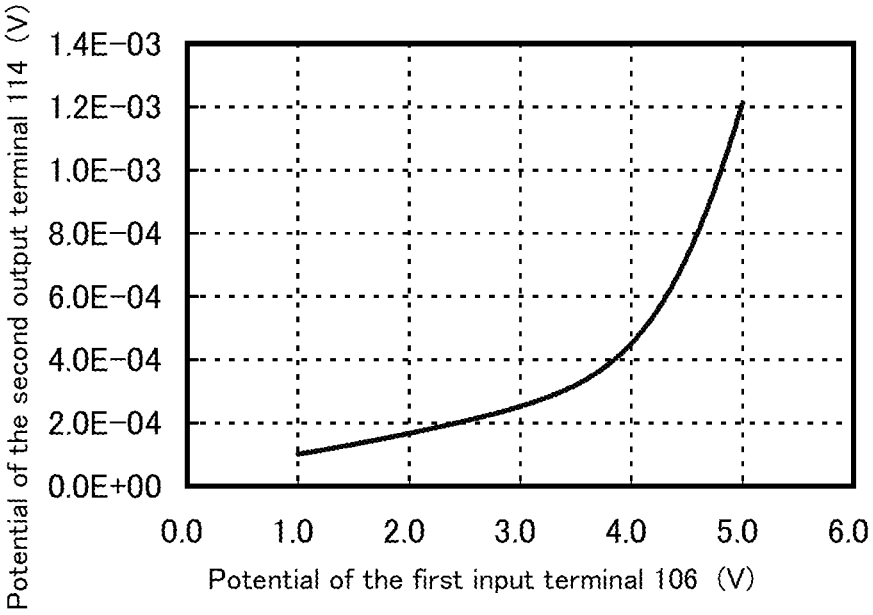
FIG. 5 shows a change in the potential of a second output terminal 114 with respect to the potential of a first input terminal 106.

FIG. 5 shows a change in the potential of the second output terminal 114 with respect to the potential (1 V to 5 V) of the first input terminal 106. The calculation conditions are as follows.

The potential of the second input terminal 108: 0 V

The potential of the third input terminal 110: −7 V

In FIG. 5, when the potential of the first input terminal 106 changes in the range of 1 V to 5 V, the potential of the second output terminal 114 also changes. In this case, the potential of the second output terminal 114 changes in the range of $1.0\times10^{-4}$ V to $1.2\times10^{-3}$ V.

Figure 6:
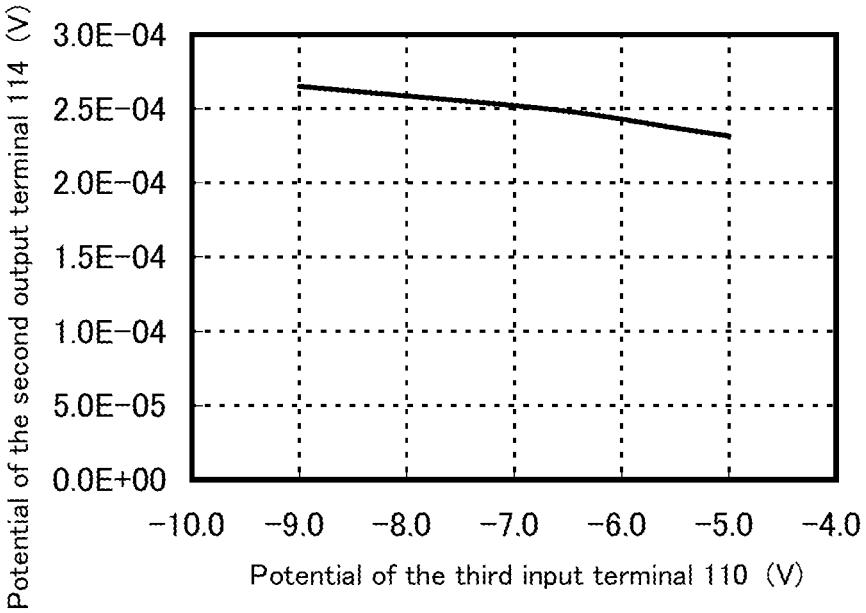
FIG. 6 shows a change in the potential of the second output terminal 114 with respect to the potential of a third input terminal 110.

FIG. 6 shows a change in the potential of the second output terminal 114 with respect to the potential (−9 V to −5 V) of the third input terminal 110. The calculation conditions are as follows:

The potential of the first input terminal 106: 3 V

The potential of the second input terminal 108: 0 V

In FIG. 6, when the potential of the third input terminal 110 changes in the range of −9 V to −5 V, the potential of the second output terminal 114 also changes. In this case, the potential of the second output terminal 114 changes in the range of $2.3\times10^{-4}$ V to $2.7\times10^{-4}$ V.

According to FIG. 5 and FIG. 6, under the condition where the potential of the second input terminal 108 is fixed to 0 V, even when the potential of the first input terminal 106 or the potential of the third input terminal 110 changes, the change in the potential of the second output terminal 114 is not great compared with the change in the potential of the first input terminal 106 or the third input terminal 110.

Figure 7:
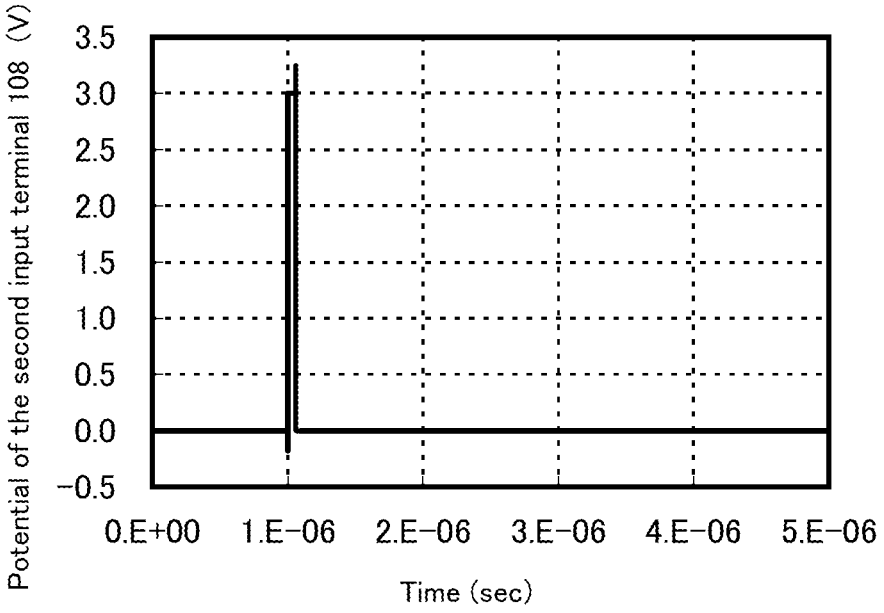
FIG. 7 shows a change in the potential of a second input terminal 108 over time when a start pulse is input.
Figure 8:
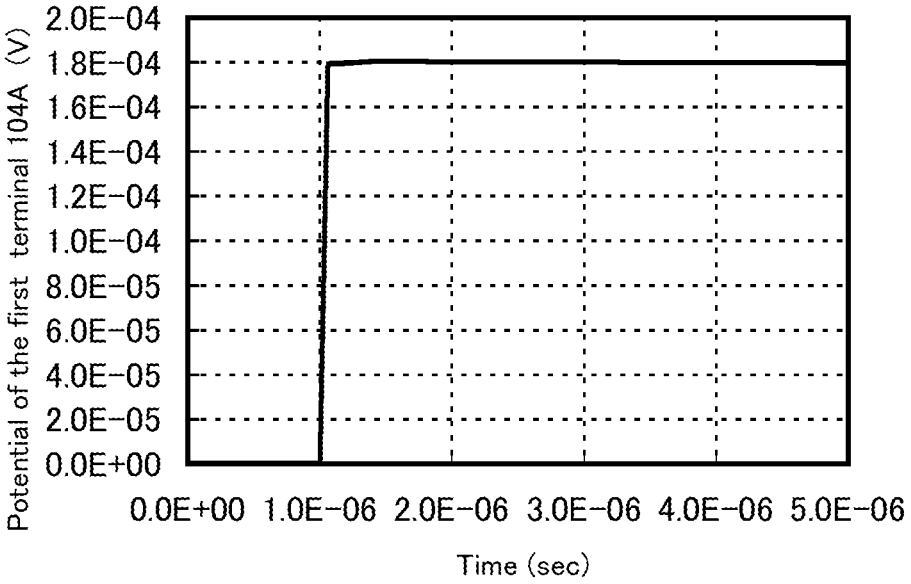
FIG. 8 shows a change in the potential of a first terminal 104A over time when a start pulse is input.
Figure 9:
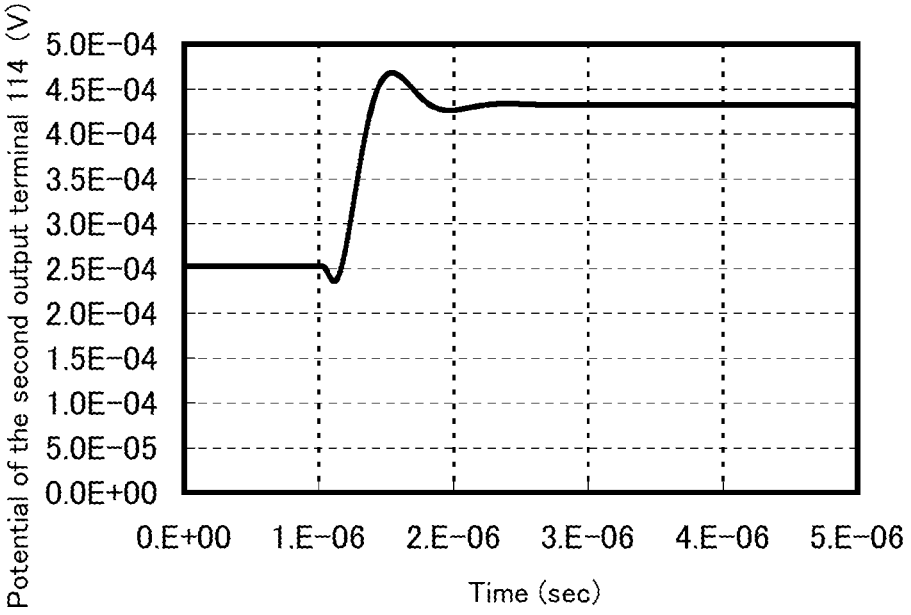
FIG. 9 shows a change in the potential of the second output terminal 114 over time when a start pulse is input.

Next, the case where a start pulse signal is input will be described. FIG. 7, FIG. 8, and FIG. 9 show changes in the potentials of terminals when a start pulse signal is input.

FIG. 7 shows a change in the potential of the second input terminal 108 when a start pulse signal is input. In FIG. 7, the start pulse signal is input at approximately $1.0\times10^{-6}$ seconds.

FIG. 8 shows a change in the potential of the first terminal 104A when a start pulse signal is input. According to FIG. 8, the potential of the first terminal 104A increases from 0

V to $1.8\times10^{-4}$ V by the input of the start pulse signal, but a rapid change in potential as in the case where pulse exists does not occur.

FIG. 9 shows a change in the potential of the second output terminal 114 when a start pulse signal is input. According to FIG. 9, the potential of the first terminal 104A slightly decreases from $2.5\times10^{-4}$ V by the input of the start pulse signal, then increases to $4.5\times10^{-4}$ V, and then decreases to and stabilizes at $4.3\times10^{-4}$ V.

In the above-described manner, by using the reference potential generation circuit which is an embodiment of the present invention, electronic devices can be operated without supplying a ground potential from the outside. The reference potential generation circuit of an embodiment of the present invention can be incorporated in a variety of electronic devices.

This application is based on Japanese Patent Application serial no. 2011-282466 filed with Japan Patent Office on Dec. 23, 2011, the entire contents of which are hereby incorporated by reference.

What is claimed is:

1. A circuit comprising:

a first resistor;

a capacitor whose electrode is electrically connected to one end of the first resistor;

a second resistor;

a first p-channel transistor whose first terminal is electrically connected to one end of the second resistor, and whose second terminal is electrically connected to a gate terminal of the first p-channel transistor;

a second p-channel transistor whose first terminal is electrically connected to the first terminal of the first p-channel transistor, and whose gate terminal is electrically connected to the gate terminal of the first p-channel transistor;

a third p-channel transistor whose first terminal is electrically connected to the first terminal of the first p-channel transistor, and whose gate terminal is electrically connected to a second terminal of the second p-channel transistor;

a first n-channel transistor whose first terminal is electrically connected to the second terminal of the first p-channel transistor;

a second n-channel transistor whose first terminal is electrically connected to the second terminal of the second p-channel transistor, whose second terminal is electrically connected to a second terminal of the first n-channel transistor, and whose gate terminal is electrically connected to the one end of the first resistor;

a third n-channel transistor whose first terminal is electrically connected to the other end of the second resistor and a gate terminal of the third n-channel transistor;

a fourth n-channel transistor whose first terminal is electrically connected to the second terminal of the first n-channel transistor, whose second terminal is electrically connected to a second terminal of the third n-channel transistor, and whose gate terminal is electrically connected to the first terminal of the third n-channel transistor;

a fifth n-channel transistor whose first terminal is electrically connected to a second terminal of the third p-channel transistor, whose second terminal is electrically connected to the second terminal of the third n-channel transistor, and whose gate terminal is electrically connected to the first terminal of the third n-channel transistor;

a sixth n-channel transistor whose first terminal is electrically connected to a gate terminal of the first n-channel transistor, whose second terminal is electrically connected to the second terminal of the third n-channel transistor, and whose gate terminal is electrically connected to the second terminal of the third p-channel transistor.

2. The circuit according to claim 1, wherein the first resistor and the capacitor constitute a low-pass filter, and wherein the second resistor, the first to the third p-channel transistors, and the first to the sixth n-channel transistors constitute a linear regulator.

3. A reference potential generation circuit comprising:

a first input terminal, a second input terminal, and a third input terminal;

a first output terminal and a second output terminal;

a low-pass filter including a first terminal, a second terminal, and a third terminal; and a linear regulator including a first terminal, a second terminal, a third terminal, and a fourth terminal, wherein the first terminal of the low-pass filter is electrically connected to the second input terminal, wherein the second terminal of the low-pass filter is electrically connected to one of the first input terminal and the third input terminal, wherein the third terminal of the low-pass filter is electrically connected to the first terminal of the linear regulator, wherein the second terminal of the linear regulator is electrically connected to the first input terminal and the first output terminal, wherein the third terminal of the linear regulator is electrically connected to the second output terminal, wherein the fourth terminal of the linear regulator is electrically connected to the third input terminal, wherein a start pulse signal is supplied to the second input terminal, wherein a potential having an opposite polarity to a potential supplied to the first input terminal is supplied to the third input terminal, and wherein a potential supplied from the second output terminal is a reference potential.

4. The reference potential generation circuit according to claim 3, wherein the low-pass filter includes a resistor and a capacitor, wherein the first terminal of the low-pass filter is electrically connected to one end of the resistor, wherein the other end of the resistor is electrically connected to the third terminal of the low-pass filter and a first electrode of the capacitor, and wherein a second electrode of the capacitor is electrically connected to the second terminal of the low-pass filter.

5. The reference potential generation circuit according to claim 3, wherein the linear regulator includes a resistor, a first p-channel transistor, a second p-channel transistor, a third p-channel transistor, a first n-channel transistor, a second n-channel transistor, a third n-channel transistor, a fourth n-channel transistor, a fifth n-channel transistor, and a sixth n-channel transistor, wherein the first terminal of the linear regulator is electrically connected to a gate terminal of the second n-channel transistor, wherein the second terminal of the linear regulator is electrically connected to one end of the resistor of the linear regulator, one of a source and a drain of the first p-channel transistor, one of a source and a drain of the second p-channel transistor, and one of a source and a drain of the third p-channel transistor, wherein the other of the source and the drain of the first p-channel transistor is electrically connected to a gate terminal of the first p-channel transistor, a gate terminal of the second p-channel transistor, and one of a source and a drain of the first n-channel transistor, wherein the other of the source and the drain of the second p-channel transistor is electrically connected to a gate terminal of the third p-channel transistor and one of a source and a drain of the second n-channel transistor, wherein the other of the source and the drain of the second n-channel transistor and the other of the source and the drain of the first n-channel transistor are electrically connected to one of a source and a drain of the fourth n-channel transistor, wherein the other end of the resistor of the linear regulator is electrically connected to one of a source and a drain of the third n-channel transistor, a gate terminal of the third n-channel transistor, a gate terminal of the fourth n-channel transistor, and a gate terminal of the fifth n-channel transistor, wherein the other of the source and the drain of the third p-channel transistor is electrically connected to one of a source and a drain of the fifth n-channel transistor and a gate terminal of the sixth n-channel transistor, wherein the other of the source and the drain of the third n-channel transistor, the other of the source and the drain of the fourth n-channel transistor, the other of the source and the drain of the fifth n-channel transistor, and one of a source and a drain of the sixth n-channel transistor are electrically connected to the fourth terminal of the linear regulator, and wherein the other of the source and the drain of the sixth n-channel transistor and a gate terminal of the first n-channel transistor are electrically connected to the third terminal of the linear regulator.

6. The reference potential generation circuit according to claim 3, wherein the reference potential is substantially equal to a ground potential.

7. A circuit comprising:

a low-pass filter;

a resistor; and first to ninth transistors, wherein a first terminal of the first transistor is electrically connected to the resistor, a first terminal of the second transistor, and a first terminal of the third transistor, wherein a second terminal of the first transistor is electrically connected to a gate terminal of the first transistor, a gate terminal of the second transistor, and a first terminal of the fourth transistor, wherein a second terminal of the second transistor is electrically connected to a gate terminal of the third transistor and a first terminal of the fifth transistor, wherein a second terminal of the third transistor is electrically connected to a first terminal of the eighth transistor and a gate terminal of the ninth transistor, wherein a second terminal of the fourth transistor is electrically connected to a second terminal of the fifth transistor and a first terminal of the seventh transistor, wherein a gate terminal of the fifth transistor is electrically connected to the low-pass filter, wherein a first terminal of the sixth transistor is electrically connected to the resistor, a gate terminal of the sixth transistor, a gate terminal of the seventh transistor, and a gate terminal of the eighth transistor, wherein a second terminal of the sixth transistor is electrically connected to a second terminal of the seventh transistor, a second terminal of the eighth transistor, and a second terminal of the ninth transistor, and wherein a first terminal of the ninth transistor is electrically connected to a gate terminal of the fourth transistor.

* * * * *